US006253502B1

(12) United States Patent
Layton

(10) Patent No.: US 6,253,502 B1
(45) Date of Patent: Jul. 3, 2001

(54) VAN WITH EXTENSIBLE BOOM

(76) Inventor: George F. Layton, 4313 Virginia Ave., Sebring, FL (US) 33872

( * ) Notice: Subject to any disclaimer, the term of this patent is extended or adjusted under 35 U.S.C. 154(b) by 0 days.

(21) Appl. No.: 09/139,718

(22) Filed: Aug. 25, 1998

(51) Int. Cl.[7] ..... E04H 12/34

(52) U.S. Cl. ..... 52/118; 52/116; 52/115; 212/180; 414/543; 414/462

(58) Field of Search ..... 52/118, 116, 115; 212/180; 414/543, 462

(56) References Cited

U.S. PATENT DOCUMENTS

| | | | | |
|---|---|---|---|---|
| 1,426,276 | * | 8/1922 | Christie | 52/111 |
| 2,493,099 | * | 1/1950 | Adams | 214/77 |
| 2,713,402 | * | 7/1955 | Balogh | 189/129 |
| 3,091,312 | * | 5/1963 | Woody et al. | 189/129 |
| 3,132,718 | * | 5/1964 | Pierce, Jr. | 182/129 |
| 3,480,109 | * | 11/1969 | Eitel et al. | 182/129 |
| 3,613,546 | * | 10/1971 | Richardson | 965/86 |
| 3,796,016 | * | 3/1974 | Wu | 51/118 |
| 3,800,965 | * | 4/1974 | Barron et al. | 214/32 |
| 3,807,108 | * | 4/1974 | Johnston | 52/115 |
| 3,972,433 | * | 8/1976 | Reed | 414/462 |
| 3,987,594 | * | 10/1976 | Rao et al. | 52/111 |
| 4,035,806 | * | 7/1977 | Powell | 343/715 |
| 4,057,942 | * | 11/1977 | Kranefeld | 52/115 |
| 4,100,707 | * | 7/1978 | Kranefeld et al. | 52/115 |
| 4,118,907 | * | 10/1978 | Small et al. | 52/115 |
| 4,170,854 | * | 10/1979 | Palmcrantz et al. | 52/115 |
| 4,249,853 | * | 2/1981 | Lyvers | 414/543 |
| 4,252,491 | * | 2/1981 | Hock | 414/540 |
| 4,394,108 | * | 7/1983 | Cook et al. | 414/680 |
| 4,406,098 | * | 9/1983 | Deaver et al. | 52/119 |
| 4,413,451 | | 11/1983 | Featherstone et al. . | |
| 4,470,229 | * | 9/1984 | Muse et al. | 52/118 |
| 4,602,462 | * | 7/1986 | Anderson | 52/119 |
| 4,815,757 | * | 3/1989 | Hamilton | 280/764.1 |
| 4,913,458 | * | 4/1990 | Hamilton | 280/6.1 |
| 4,932,176 | * | 6/1990 | Roberts et al. | 52/118 |
| 4,943,019 | * | 7/1990 | Mester | 248/123.1 |
| 5,020,957 | * | 6/1991 | Liston | 414/279 |
| 5,117,595 | * | 6/1992 | Brendel | 52/115 |
| 5,123,799 | * | 6/1992 | Breazeale | 414/462 |
| 5,177,516 | * | 1/1993 | Fitz et al. | 354/81 |
| 5,281,078 | * | 1/1994 | Mills, Jr. | 414/680 |
| 5,318,313 | * | 6/1994 | Chapman | 280/47.11 |

(List continued on next page.)

FOREIGN PATENT DOCUMENTS

2580563 * 10/1986 (FR) ..... 414/543

OTHER PUBLICATIONS

1986 Chevrolet Owner's Manual entitled "Chevy Van", cover and pp. 0–5 and 0–6.

*Primary Examiner*—Carl D. Friedman
*Assistant Examiner*—Dennis L. Dorsey
(74) *Attorney, Agent, or Firm*—Nixon & Vanderhye P.C.

(57) ABSTRACT

A conventional cargo or passenger-type van (typically about 14–24 feet in length) is fitted with a boom assembly that is readily transported with the van in a collapsed position and substantially parallel to the van roof, but can be elevated to a substantially vertical position, and quickly extended upwardly to full height. Where four booms are used, full height may be about 65 feet, or even more. A support frame is provided which substantially supports a main pedestal exteriorly of the roof and connected to the booms and an extension cylinder, to the van's main frame, including initially telescopic support posts disposed inside the van interior which do not impede access to the van interior from the side and rear doors, and which leave the center of the van interior essentially unobstructed. A pivotal connection for the first boom about which it moves from a transport to a substantially vertical position is mounted slightly to the rear of the centerline of the rear axle of the van. A removable equipment mounting end cap containing whatever equipment is desirably elevated by the booms is mounted on the most vertical (when extended) of the booms.

13 Claims, 12 Drawing Sheets

U.S. PATENT DOCUMENTS 5,364,049 * 11/1994 Long ..... 248/205.1
5,494,397 * 2/1996 Wilson ..... 414/728
5,572,837 11/1996 Featherstone et al. .
5,611,177 * 3/1997 Herbstritt ..... 52/111
5,615,855 * 4/1997 Marue et al. ..... 248/405
5,618,150 * 4/1997 Poindexter ..... 414/462
5,697,757 * 12/1997 Lindsay ..... 414/744.6
5,743,635 4/1998 Hulse .
5,806,865 * 9/1998 Chapman ..... 280/47.11
5,961,092 * 10/1999 Coffield ..... 248/539

* cited by examiner

VAN WITH EXTENSIBLE BOOM

BACKGROUND AND SUMMARY OF THE INVENTION

There are many situations in which it is desirable to elevate an object of equipment. For example, test equipment, including antennas, video cameras, microwave receiving dishes, and the like, often times need to be elevated at various locations to distances as high as 65 feet in a quick, safe, and efficient manner. Heretofore, this has not been practical except at high cost and at great difficulty. However, according to the present invention a relatively simple system is provided which allows those goals to be accomplished in a cost effective manner.

In contrast to a known prior art system for elevating test equipment to a height of about 65 feet, with a typical cycle time of about 20 minutes, according to the present invention a van with a boom assembly is provided which can elevate test equipment to a height of 65 feet (or possibly even more, or to substantially any level below 65 feet) in less than 5 minutes and in a safe and efficient manner. Despite the ability to accomplish these objectives, the van according to the invention has a substantially unobstructed interior, so that the van may still be loaded with whatever cargo is necessary to accomplish all of the desired objectives, or so that the van can have multiple uses. It is preferred that the van utilized in the system according to the invention comprise a conventional 16–24 foot van, of the type commonly used for passengers or for cargo, but preferably provided with a cargo configuration interior, such as those manufactured by Ford, Chevy and Dodge.

According to one aspect of the present invention, a van with a boom assembly is provided comprising the following components: A van (e.g. a fourteen—twenty-four foot van) including a front axle, a rear axle, a (substantially flat) roof, a floor, an interior, and a main frame for mounting the front and rear axles. A boom assembly positioned above the roof and comprising: a main pedestal; an extension linear actuator (e.g. hydraulic cylinder) assembly having a movable (e.g. piston) rod with a free end, and an end of the actuator (cylinder) assembly opposite the rod free end; a first boom having first and second ends; a first pivotal connection for operatively pivotally mounting the first boom adjacent the first end to the main pedestal for pivotal movement about an axis substantially parallel to the rear axle; a second pivotal connection for operatively pivotally mounting the free end of the rod to one of the first boom and the main pedestal, and a third pivotal connection for operatively pivotally mounting the opposite end of the linear actuator assembly to the other of the main pedestal and the first boom. A support frame which is disposed in the van interior and substantially supports the main pedestal on the main frame. And a second boom which telescopes with respect to the first boom; the extension linear actuator assembly capable of moving the first boom from a first position substantially parallel to the van roof to a second position substantially perpendicular to, and extending upwardly from, the van roof.

The support frame typically comprises a plurality of substantially vertical support posts, each post telescoping so as to allow ready movement into the van interior, and then to effectively support the main pedestal once fastened within the van interior; and a plurality of cross elements connecting the posts adjacent the tops thereof. The assembly also typically further comprises a plurality of spacers disposed between the roof and main pedestal above the roof, and between the roof and cross elements within the van interior; and a plurality of spacers disposed between the support frame and the floor in the van interior, and a plurality of spacers operatively disposed between the floor and the van main frame below the floor. Most of the components are preferably made of square metal (e.g. steel) tube or the like. The van typically has rear and side doors, and the support frame is disposed in the van interior in a manner which does not interfere with ingress or egress through the doors, and leaves the center of the van interior substantially unobstructed.

The assembly also typically further comprises a lift linear actuator (e.g. hydralic cylinder) connected between the first and second booms for linearly moving the second boom with respect to the first boom in telescoping relationship; and a common electrically powered actuator for the linear actuators, e.g. a hydraulic fluid pump for supplying hydraulic fluid under pressure to the extension and lift cylinders. The electric power for powering the pump, and solenoid operated valves associated therewith, preferably comprises one or more batteries mounted in the van, such as a pair of six volt batteries distinct from the van battery for starting the engine, but charged by the van's alternator. The supply of electric current to the pump and valves is controlled through a control box mounted on an elongated electric cable allowing an operator to stand at a position remote from the van to observe movement of the booms while operating the control box.

The assembly further preferably comprises a third boom telescoping within the second boom, and movable substantially vertically upwardly with respect to the second boom by a cable and roller connection between the first and third booms; a fourth boom telescoping within the third boom, and movable substantially vertically upwardly with respect to the third boom by a cable and roller connection between the second and fourth booms; and further comprising a removable equipment-mounting end cap for the fourth boom (or for a subsequent boom if more than four).

The first pivotal connection for the first boom when in the second position is located on the opposite side of the rear axle from the front axle so as to allow substantially the full weight of the van to stabilize the booms, to allow substantially the full length of the van to be used to mount the booms in the first position, and to substantially insure that the actual axle weights of both axles are below the GVW ratings thereof. That is, preferably the centerline of the first pivotal connection when the first boom is in the second position is approximately 12–20 inches (e.g. about 16 inches) to the rear of the centerline of the rear axle.

While the invention is most effective for conventional 16–24 foot vans, specialty vans or other vehicles may also be used to provide the system according to the invention, e.g. larger trucks may also utilize some of the principles of the invention. The system according to the invention is capable of elevating test equipment or the like not only quickly, safely, and efficiently, but also so that it can be lowered in such a way that tests can be conducted at several elevations.

It is a primary object of the present invention to provide a van with a boom assembly that allows, quick, safe, efficient, and cost effective transport in utilization of a wide variety of different types of equipment, up to heights of 65 feet, or even more. This and other objects of the invention will become clear from an inspection of the detailed description of the invention and from the appended claims.

DETAILED DESCRIPTION OF THE DRAWINGS

Figure 1:
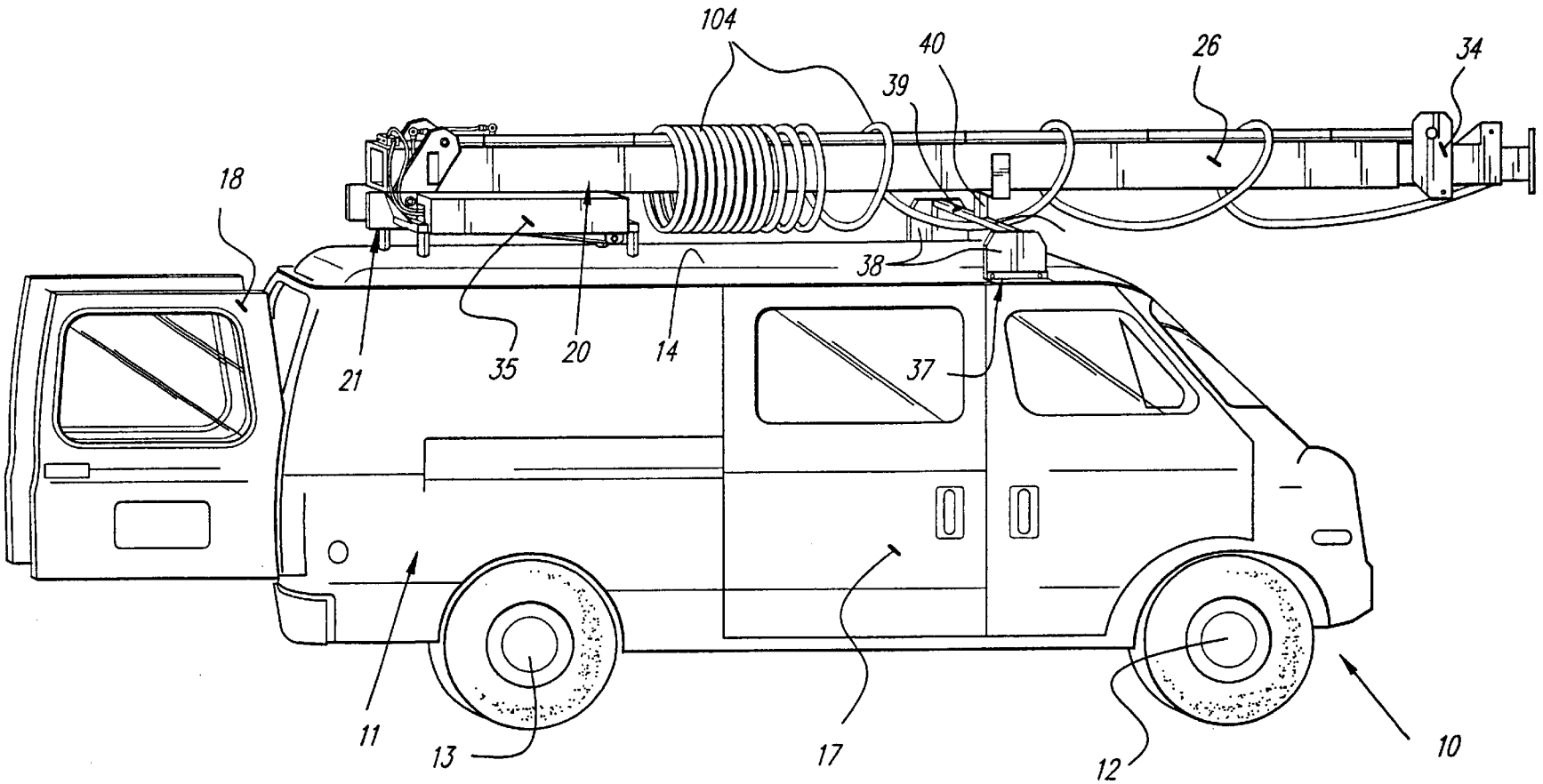
FIG. 1 is a rear perspective view of an exemplary van with boom assembly according to the present invention with the boom assembly in the collapsed transport position.
Figure 2:
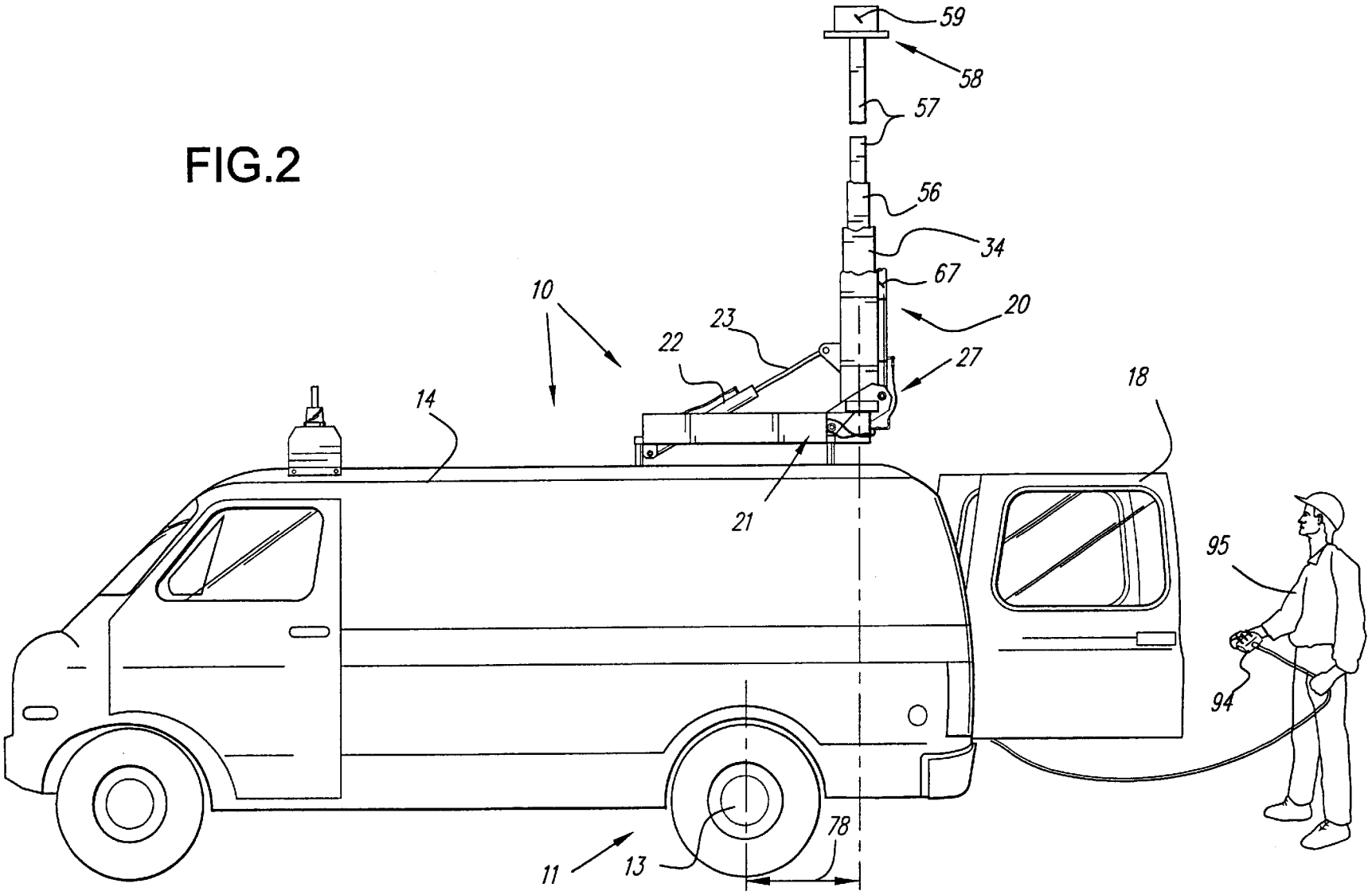
FIG. 2 is a side view of the van and boom assembly of FIG. 1 showing the boom assembly substantially vertical position with maximum extension.
Figure 5:
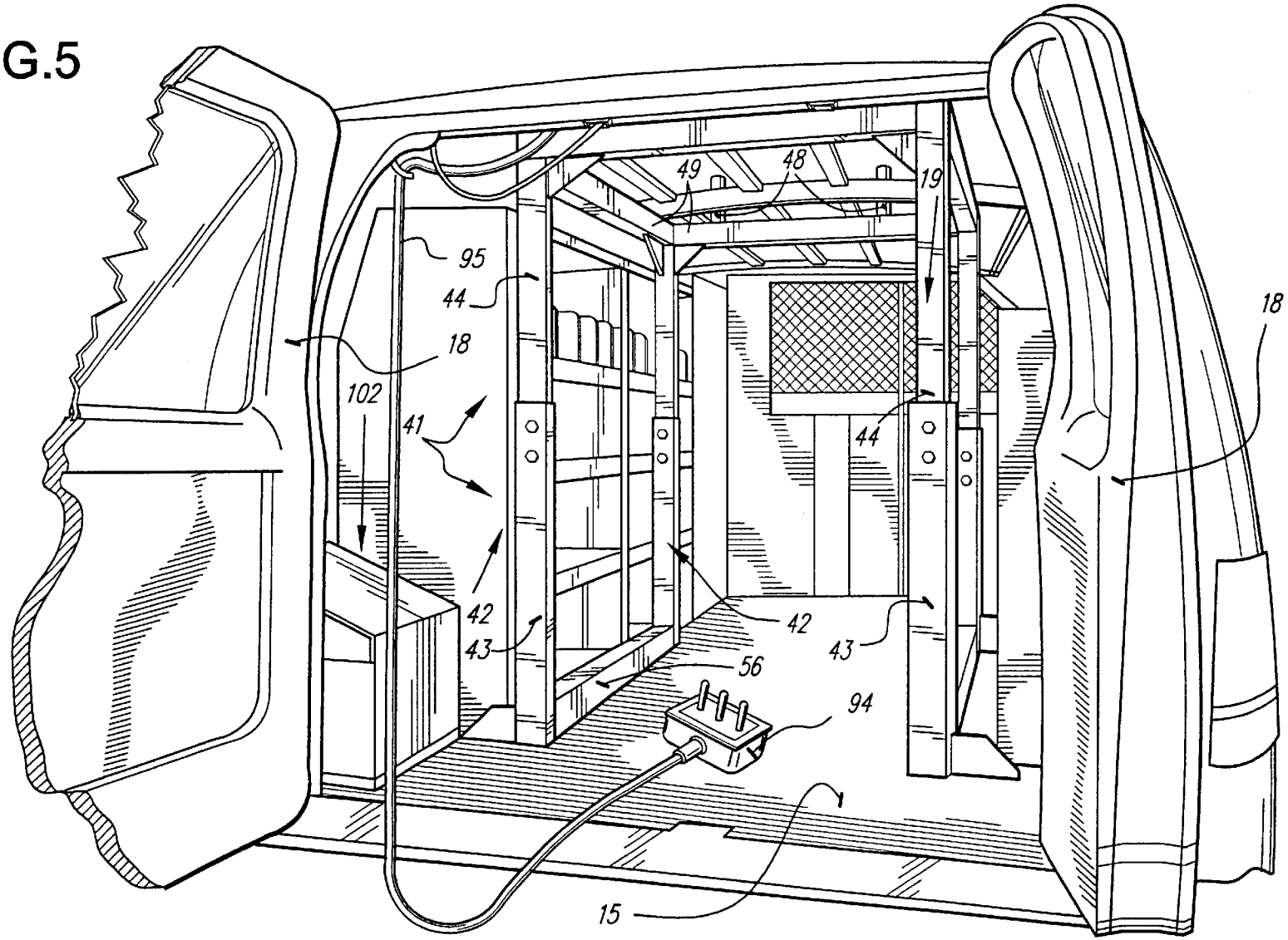
FIG. 5 is a perspective view, looking in through the rear door of the van of FIGS. 1 through 4, showing the support frame for supporting the boom assembly in the interior of the van.
Figure 8:
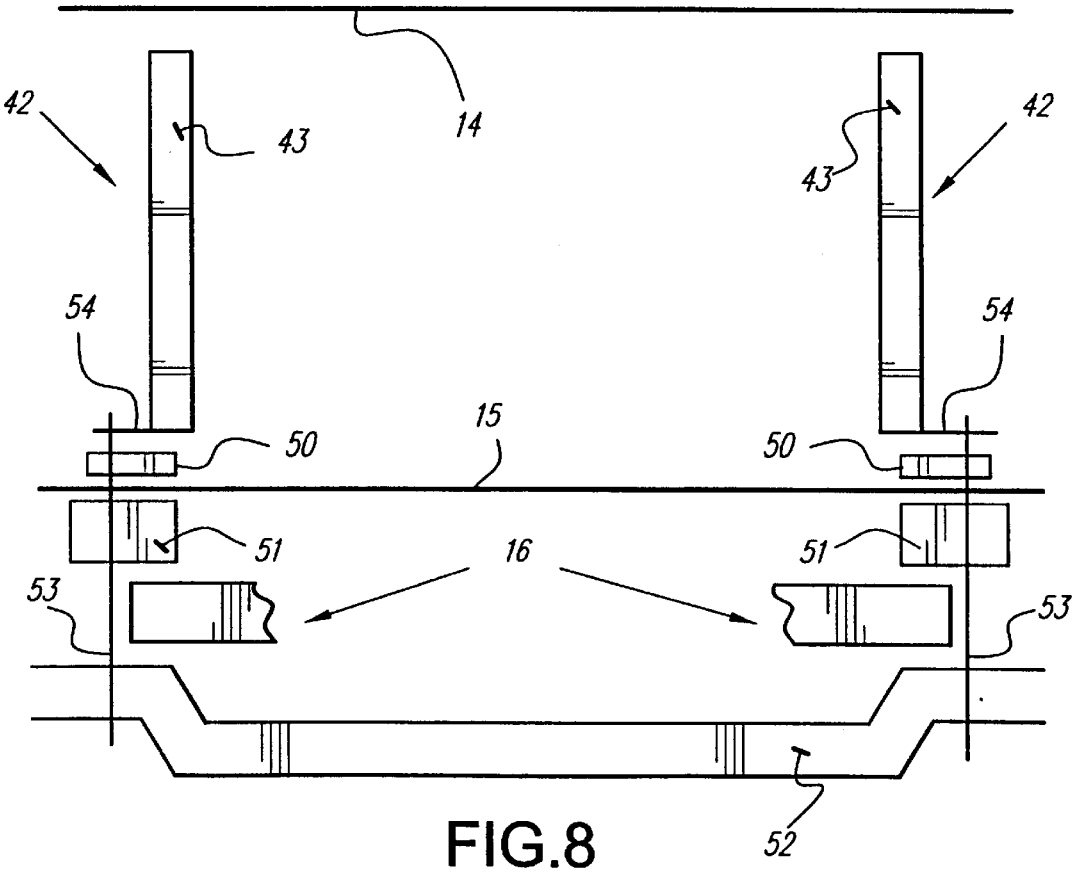
FIGS. 8 and 9 are very schematic views showing mounting of the support frame of FIGS. 5 through the frame of the van.
Figure 9:
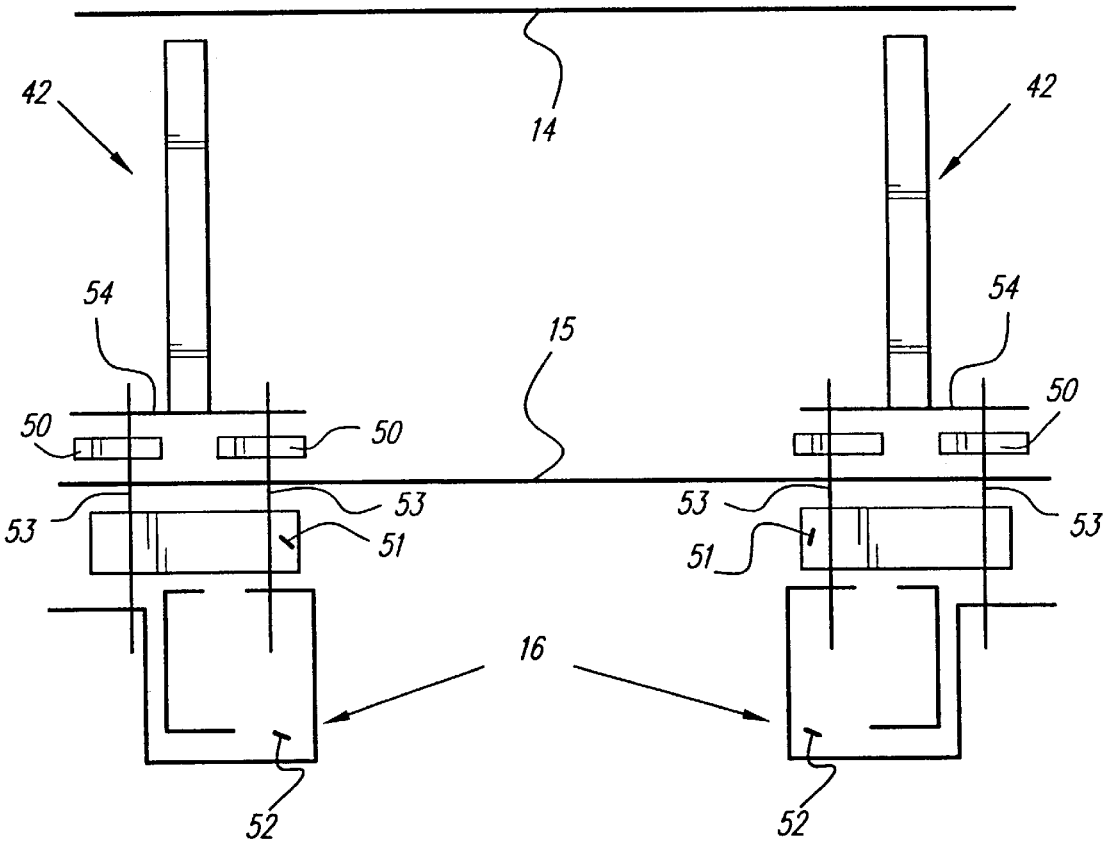

A van with boom assembly according to the present invention is shown generally by reference 10 in FIGS. 1 and 2. The first component includes a van 11, which preferably is a conventional fourteen—twenty-four foot van such as made by Chevy, Ford, or Dodge, for passenger or cargo use, including a front axle 12 with wheels, a rear axle 13 with wheels, a substantially flat roof 14, a floor 15 (see FIGS. 5, 8, and 9 in particular), a main frame/chassis mounting the front and rear axles 12, 13, the main frame being shown only schematically at 16 in FIGS. 8 and 9, at least one side door 17 (see FIG. 1), and at least one rear door 18 (such as the two doors 18, as seen most clearly in FIGS. 2 and 5). The van 11 typically is configured as a cargo van, as seen from the interior view of FIG. 5, and according to one feature of the invention the interior, shown generally by reference numeral 19 in FIG. 5, is constructed so that there is substantially central portion thereof, substantially unobstructed by support structures or the like associated with the boom assembly 20.

Figure 3:
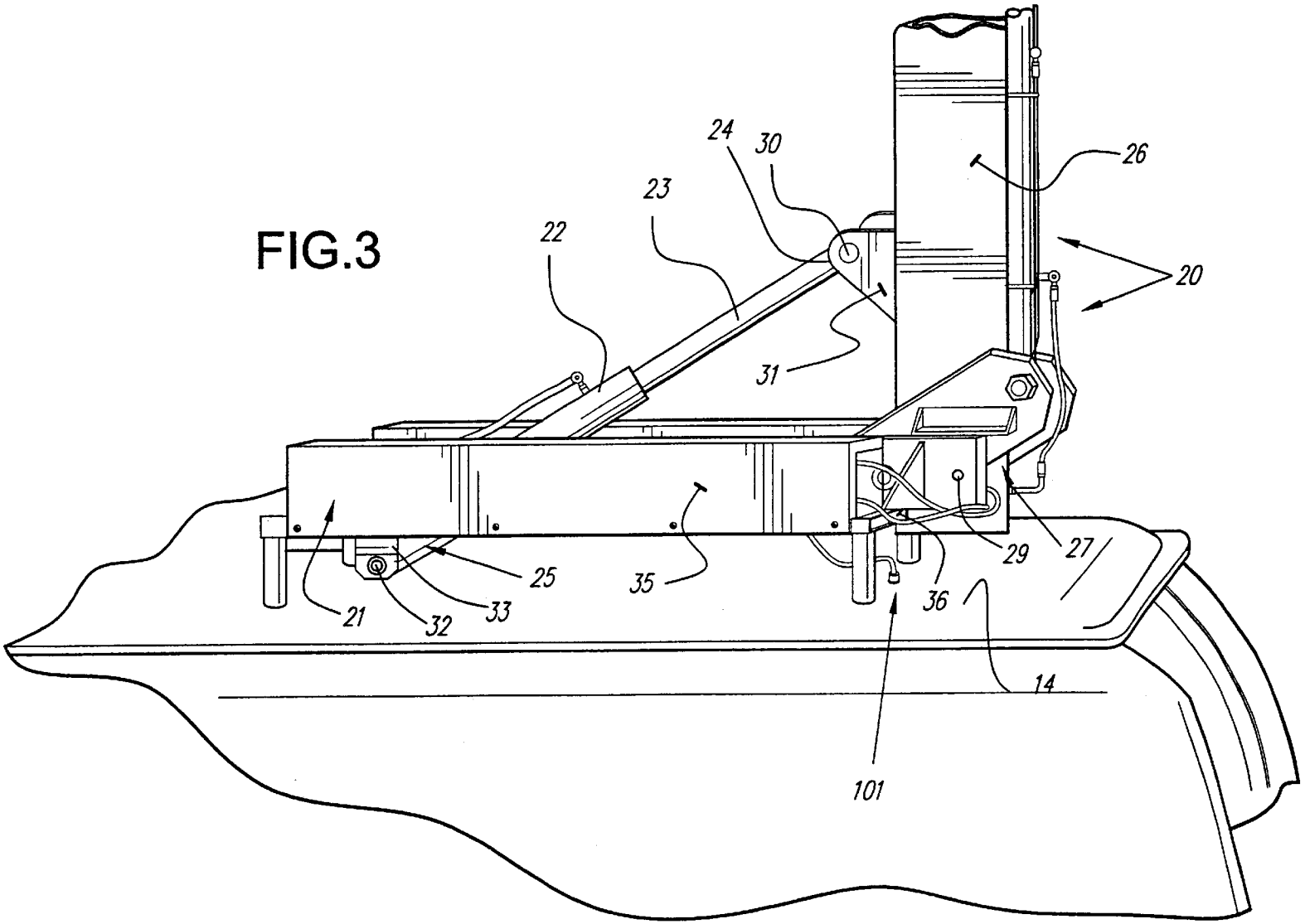
FIG. 3 is a detail rear perspective view of the extension cylinder and its cooperation with other boom assembly components when the boom assembly is in the position of FIG. 2.

The boom assembly 20 is positioned above the roof 14 and comprises a main pedestal—shown generally by reference numeral 21—as well as a hydraulic extension cylinder assembly 22 having a piston rod (see FIG. 3 in particular) 23 with a free end 24 and an end 25 of the cylinder assembly 22 opposite the piston rod free end 24; a first boom 26 having a first end 27 and a second end 28; a first pivotal connection shown schematically at 29 (and comprising any suitable pivot arrangement such as a pivot pin or shaft mounted in bearings associated with the main pedestal 21) (e.g. a pivot pin or shaft) for operatively pivotally mounting the first boom 26 adjacent the first end 27 thereof to the main pedestal 21 for pivotal movement about an axis substantially parallel to the rear axle 13; and a second pivotal connection 30 (e.g. a pivot pin or shaft) for operatively pivotally mounting the free end 24 of the piston rod 23 to one of the first boom 26 and the main pedestal 21 (in FIG. 3 shown mounted to the ears 31 extending outwardly from the first boom 26). The boom assembly 20 also comprises a third pivotal connection 32 (see FIG. 3) for operatively pivotally mounting the opposite end 25 of the cylinder assembly to the other of the main pedestal 21 and the first boom 26 (shown mounted to the flanges 33 connected to the main pedestal 21 in FIG. 3). The van and boom assembly combination 10 also comprises a second boom 34 which telescopes with respect to the first boom 26.

While the invention has been above, and will be below, described with respect to the preferred embodiment of hydraulic cylinders, it is to be understood that other known and conventional linear actuators can be used including pneumatic cylinders, rack and pinion assemblies, or other mechanical devices which have substantially linear relative movement between portions thereof.

Figure 4:
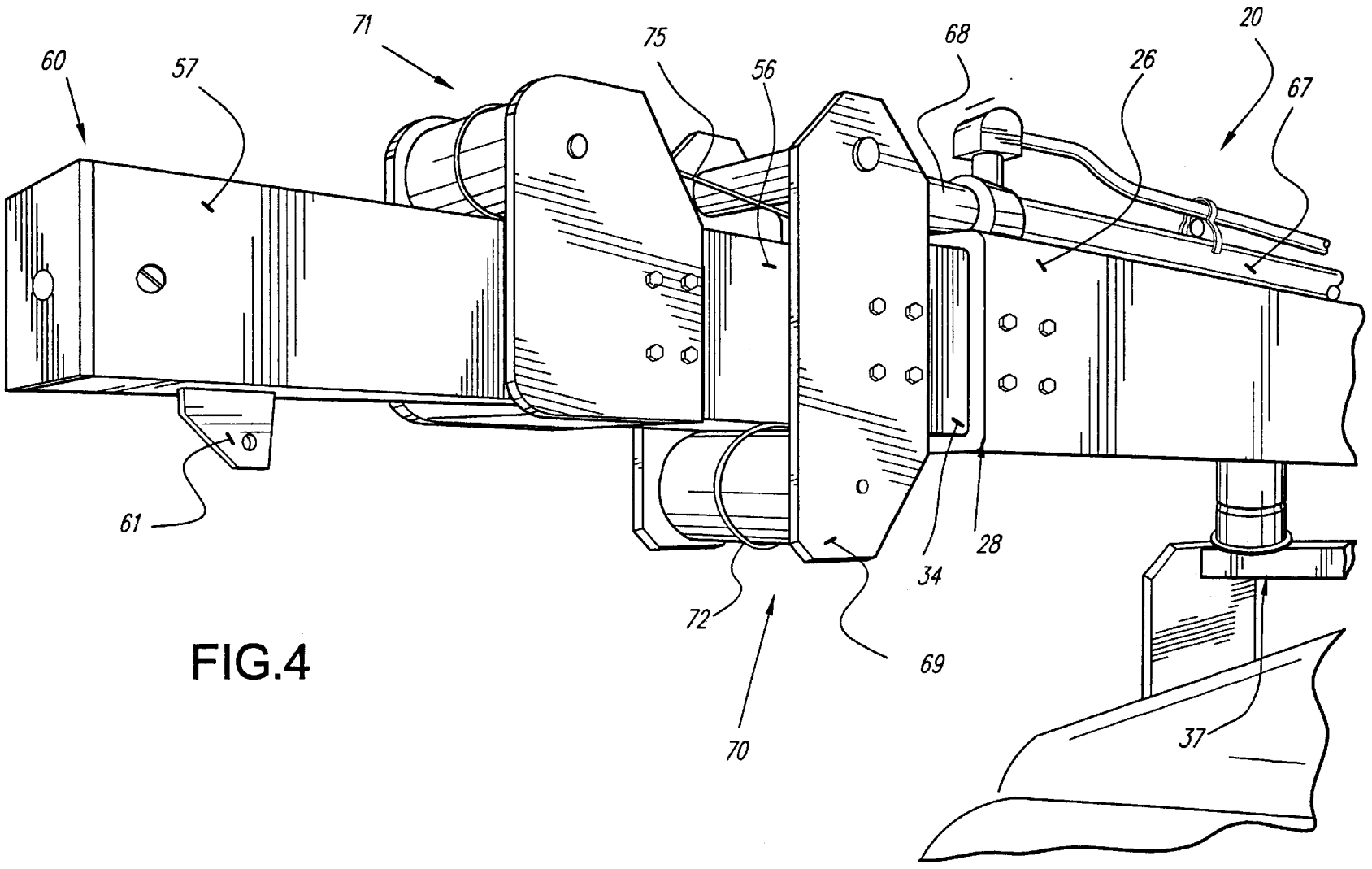
FIG. 4 is a front perspective view of the free end of the boom assembly when in a collapsed position for an embodiment for which there are four telescoping booms.
Figure 11:
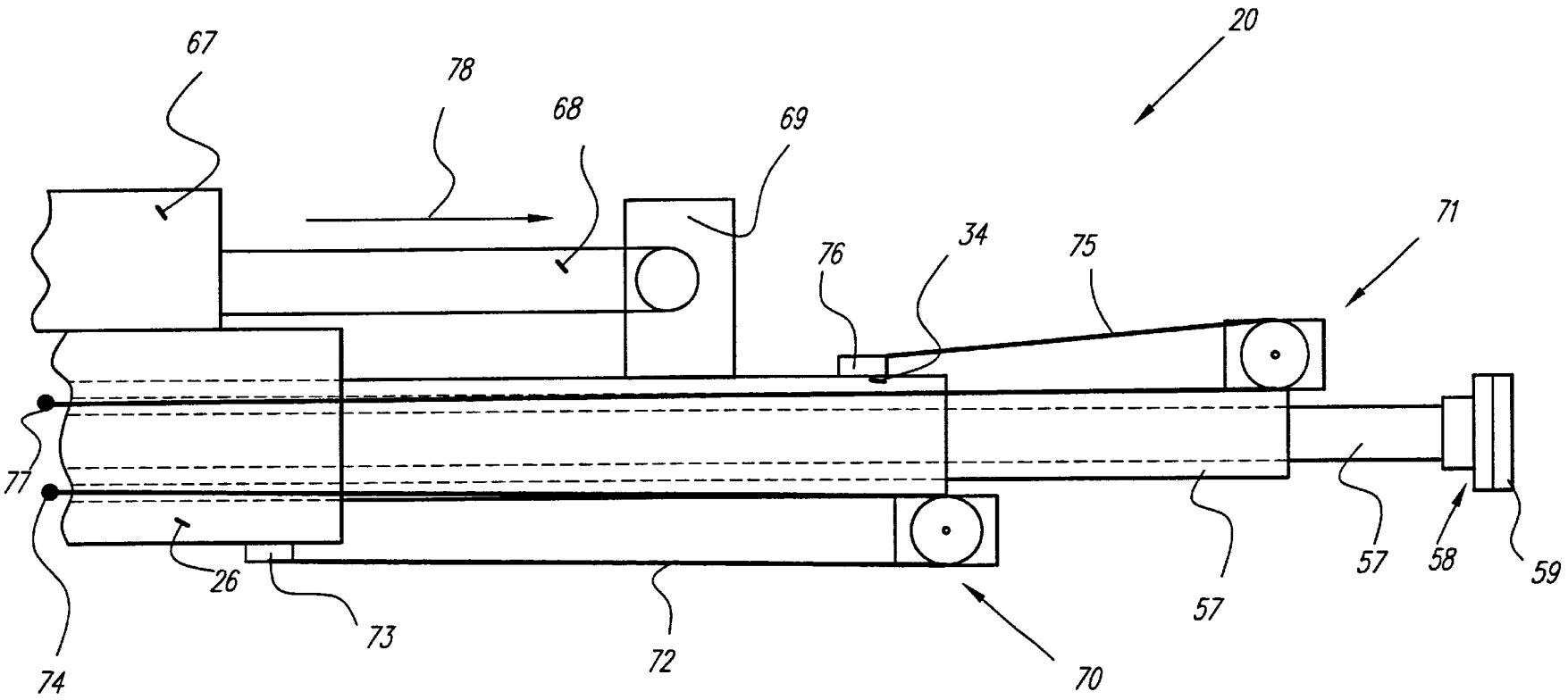
FIG. 11 is a side schematic view showing the cooperation between the booms of the boom assembly when four booms (as in FIGS. 1, 2, and 4) are provided.

The hydraulic extension cylinder assembly 22 is capable of moving the first boom 26 from a first position substantially parallel to the van roof 14 (that is a storage/transport position as illustrated in FIGS. 1 and 4) to a second position substantially perpendicular to, and extending upwardly from, the van roof 14 (that is in operating position, such as illustrated in FIGS. 2, 3 and 11).

Figure 6:
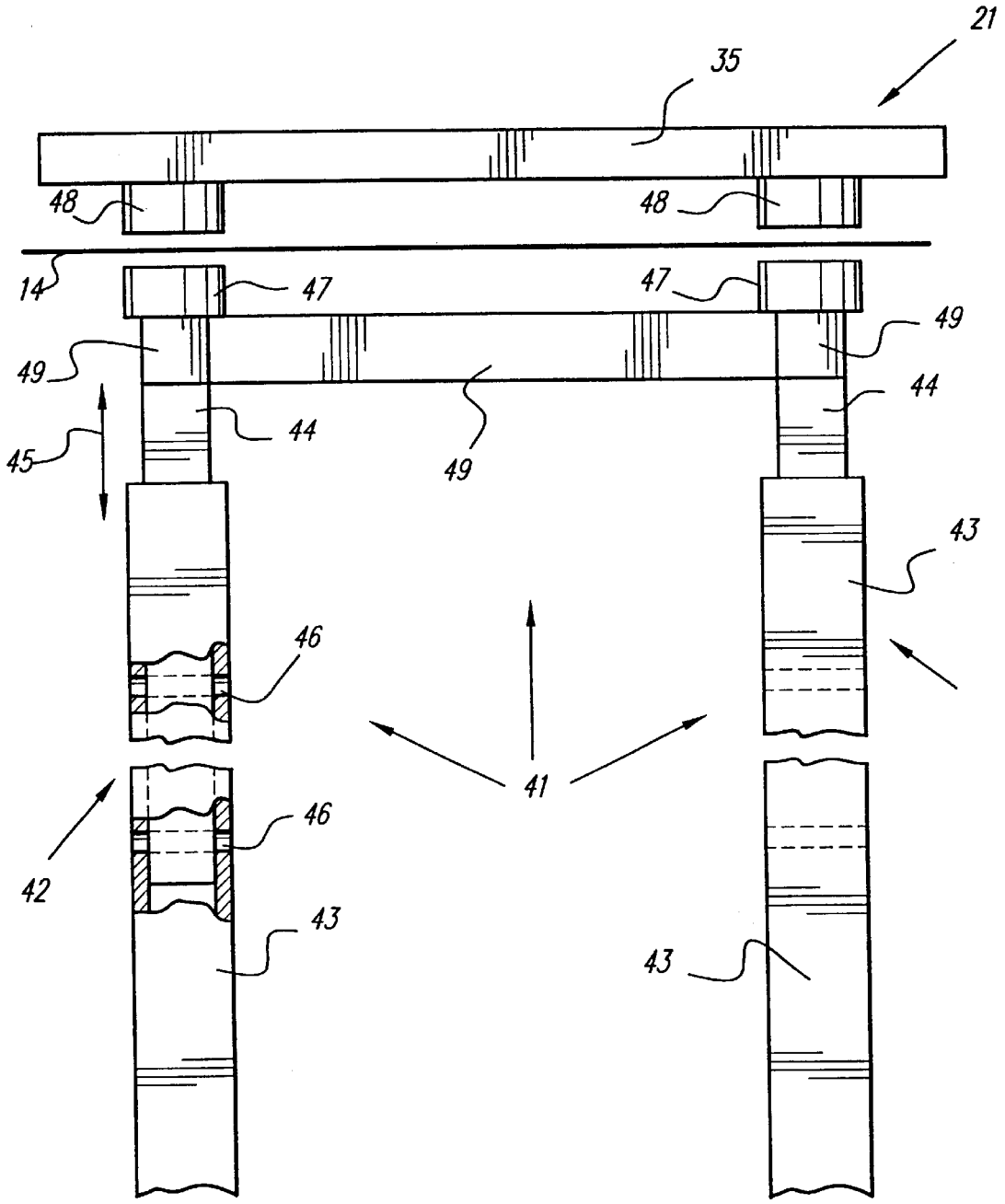
FIGS. 6 and 7 are side and front very schematic views of the cooperation between the main pedestal components, van roof, and interior support frame of the construction of FIGS. 1 through 5.
Figure 7:
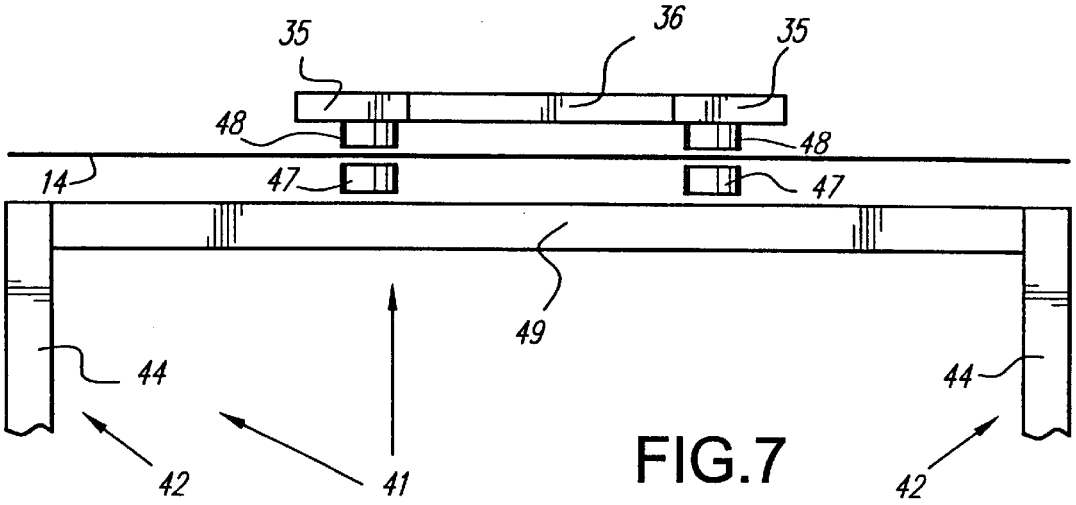

While the main pedestal 21 may have a wide variety of constructions, the preferred construction thereof, which is perhaps most clearly visible in FIGS. 1, 3, 6, and 7 (FIGS. 6 and 7 are very schematic), includes first and second side tubes 35 substantially parallel to the direction of elongation of the van 11 and spaced from each other in a direction substantially perpendicular thereto; and a pair of end supports 36 extending substantially perpendicular to the side pieces 35 and connecting them together adjacent the front and rear ends thereof. All of the pieces 35, 36 may be made of metal bar or tube, such as square steel tubing. The pieces 35, 36 can be attached together by bolts, welding, or in any other suitable manner. The flanges 33 extend downwardly from each the side pieces 35 adjacent the front ends thereof and receive the pivot pin 32 for mounting the opposite end 25 of the cylinder assembly 22. The front cross piece 36 also serves to operatively engage the bottom of the first boom 26 when in the storage/transport position of FIGS. 1 and 4.

To assist in properly positioning the boom assembly 20 in the storage/transport position of FIGS. 1 and 4, a second pedestal, shown generally by reference numeral 37 in FIGS. 1 and 4—may be provided. The second pedestal 37 merely comprises a pair of end pieces 38 which are secured to the roof 14 and have a cross piece 39 extending therebetween, with a substantially centrally located support arm 40 extending upwardly therefrom and engaging the bottom surface of the first boom 26 as clearly seen in FIG. 1. If desired the first boom 26 may be lashed to support arm 40 and/or the cross piece 39 with shock cord, rope, or the like, but that normally is not necessary.

In order to properly support the main pedestal 21 adjacent the rear of the van 11 in a secure and safe manner, but while not significantly adversely interfering with the interior 19 of the van 11, a particular support frame is provided according to the invention. This support is shown only generally by reference numeral 41 in FIGS. 5 through 9, with various components thereof also visible in more detail in FIGS. 5 through 9.

The support frame 41 includes a plurality of (e.g. four) substantially vertical support posts 42. Each support post 42 preferably comprises a lower portion 43 and an upper portion 44. The portions 43, 44 telescope with respect to each other, as indicated by the arrow 45 in FIG. 6, so that they may be moved into the interior 19 in a collapsed configuration (with the portion 44 completely, or partially, within the portion 43), and then when the posts 42 are inside interior 19 and to be used to support the main pedestal 21, the portions 44 are moved upwardly with respect to the portions 43 so as to effectively engage the bottom of the van roof 14, and then are held in that place by any suitable mechanism, such as the bolts 46 passing through both of the portions 43, 44. Welding, or any other mechanism, can be utilized to hold the portions 43, 44 in the support position (illustrated in FIG. 5). In the preferred embodiment illustrated in the drawings, four posts 42 are utilized.

Preferably the posts 42 engage the van roof 14 through spacers 47 which have an enlarged area so as to insure that the support force from the post 42 is spread out over a sufficient area so that the van roof 14 is not undesirably deformed. The side members 35 of the main pedestal 21 are then connected through the spacers 47, and spacers 48 on the outside of the van roof 14 to the posts 42 as by using bolts, or the like so that the main pedestal 21 is in fact actually effectively supported primarily by the support frame 41.

The support frame 41 also includes a plurality of cross elements 49 connected adjacent the tops of the posts 42 (the upper portions 44 thereof and typically the spacers 47 are actually connected to the cross pieces 49, as seen in most clearly in FIGS. 5 and 7.

The bottom portions 43 of the posts 42 are also effectively connected to the van frame 16 (see FIGS. 8 and 9) so that the entire support structure 41 mounts the main pedestal 21 supported by the frame 16. While this may be accomplished in a number of different manners, one manner for accomplishing this purpose is illustrated schematically in FIGS. 8 and 9 where steel spacers to level the van floor 15—those spacers illustrated schematically at 50 in FIGS. 8 and 9—are connected to the bottoms of the post portions 43 above the floor 15, and other steel spacers 51 are connected between the floor 15 and the frame 16, typically utilizing a steel mounting fixture 52 which extends below the frame 16. A plurality of bolts 53 pass through bottom flanges 54 of the posts 42, the spacers 50, 51, and the steel mounting fixture 52, the bolts 53 essentially clamping the van frame 16 between the components 51, 52 which effectively ties the support frame 41 to the van frame 16. Optional steel tube cross members 56 (see FIG. 5) may be provided between the bottoms of the posts 42 extending along the length of the van 11. However, cross pieces like the cross pieces 56 are preferably not provided width-wise because that would interfere with the access to the interior 19 of the van 11, and it is desired to keep the interior 19 substantially unobstructed, as illustrated in FIG. 5, and so that the support frame 41 does not interfere with the access to the interior 19 through the doors 17 or 18.

Figure 10:
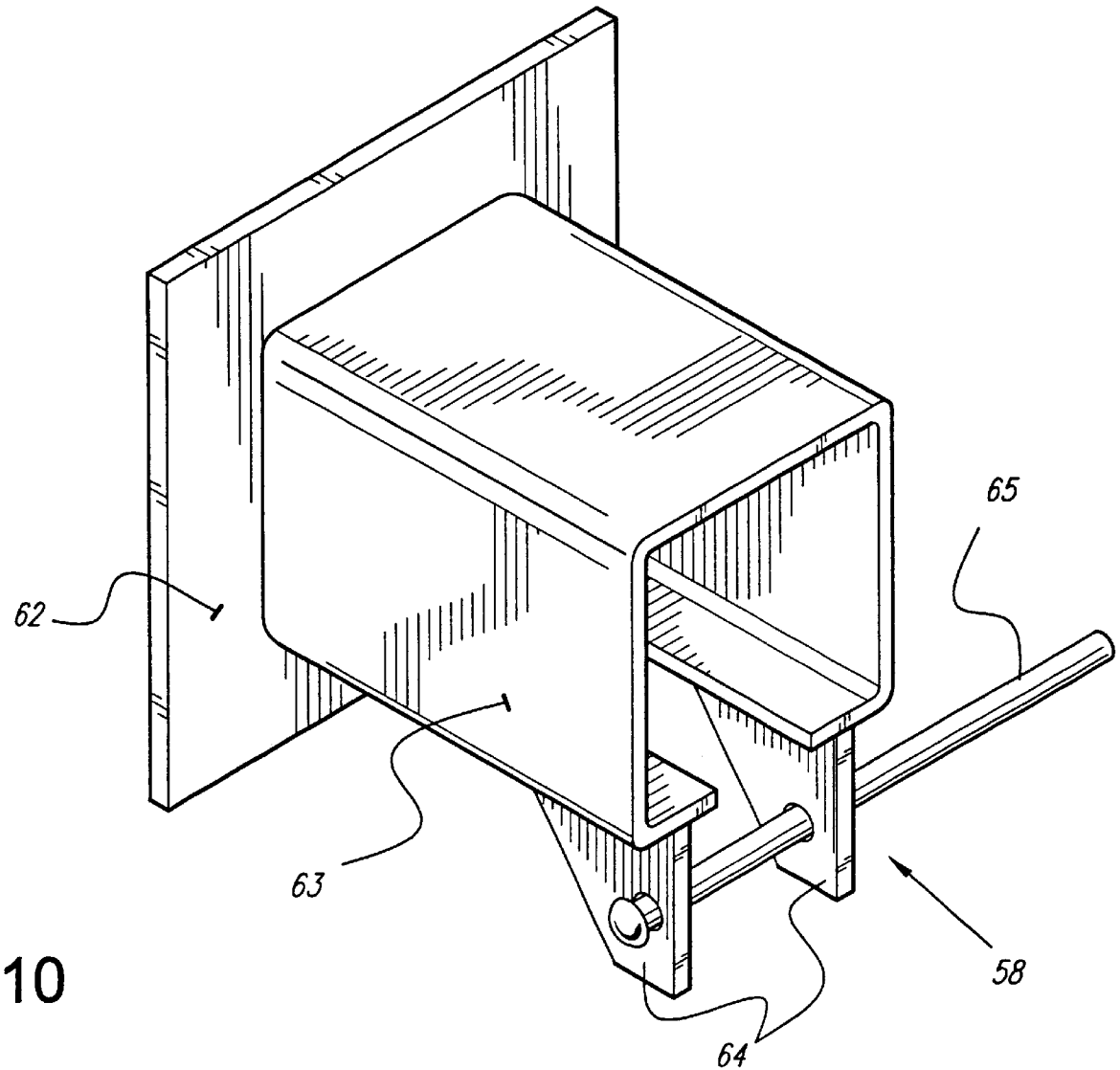
FIG. 10 is a bottom perspective view of an exemplary end cap assembly utilizable to mount equipment on the verticalmost of the booms of the boom assembly when in the extend position.

As seen most clearly in FIGS. 2, 4 and 11, the boom assembly 20 in addition to the first and second booms 26, 34, preferably also comprises a third boom 56 and a fourth boom 57. Mounted at the end of the fourth boom 57 is a removable end cap 58—see FIG. 10—which is designed to support test equipment, or any other suitable equipment, as illustrated schematically only at 59 in FIGS. 2 and 11. The end cap 58 preferably comprises an aluminum weldment. FIG. 4 shows the free end 60 of the fourth boom 57 which has a mounting flange 61 thereon. Since cap 58 is removable, the test equipment or the like may be taken off the boom assembly 20 without disassembling the components of the test equipment. The end cap 58 includes an end plate 62 and a tubular portion 63 having an inside cross sectional area slightly greater than the outside cross sectional area of the free end 60 of the fourth boom 67. The tubular portion 63 of the end cap 58 has flanges 64 extending downwardly therefrom and support bolts or rods 65 which can pass through openings in the flanges 64 and a corresponding opening in the flange 61 to prevent relative vertical movement between the end cap 58 and the fourth boom 57.

In the preferred embodiment illustrated in the drawings, each of the booms 26, 34, 56 and 57 is steel square tubing, or other tubing having a substantially polygonal cross section. A hydraulic lift cylinder 67 is mounted to the first boom 26 and includes a piston rod 68 connected to a horizontal (when extended) plate 69 extending outwardly from the second boom 34 so that when the piston rod 68 is extended the second boom 34 moves (telescopes) with respect to the first boom 26, e.g. typically a distance of about 12–15 feet.

The third and fourth booms 56, 57 automatically extend when the piston rod 68 extends in view of the particular cable and roller connections between the booms, as seen in FIGS. 4 and 11. For clarity of illustration in FIG. 11 a first roller 70, mounted for movement with the second boom 34, is shown spaced from the plate 69, but as seen in FIG. 4 the same plate 69 can be used to both connect the piston rod 68 to the second boom 34 and the roller 70 to the boom 34 (on an opposite side thereof from the piston rod 68 connection). A second roller 71 is mounted to the third boom 56, preferably on the opposite side thereof from that at which the first roller 70 is mounted to the second boom 34.

A steel cable 72 is attached to the first boom 26 at one end of cable 72, as indicated by the schematic attachment 73 in FIG. 11. The cable 72 then wraps around the roller 70 (which rotates about a substantially horizontal axis) and then passes into the space between the booms 26, 34, and is attached—as indicated schematically only at 74 in FIG. 11—to a portion of the third boom 56 remote from the free end 60 of the fourth boom 67. Similarly, a cable 75 is attached at one end thereof—as illustrated schematically at 76 in FIG. 11—to the second boom 34, the cable 75 goes around the roller 71 which has an axis of rotation that is also substantially horizontal, and then the opposite free end of the cable 75 is attached—as illustrated schematically at 77 in FIG. 11—to a portion of the fourth boom 57 remote from the free end 60 thereof.

Given the interconnection between the components illustrated in FIG. 11, when the piston rod 68 is extended—as illustrated by arrows 78 in FIG. 11—to move the equipment 59 vertically upwardly, acting through the ears 69 the second boom 34 is directly moved upwardly. Since it is moved upwardly, in direction 78, it moves the roller 70 with it. Since the cable 72 has a fixed length, and the portion thereof between the attachment 73 and the roller 70 is thus being lengthened, the opposite end of the cable 72 connected at 74 causes the third boom 56 to move upwardly in synchronization with the movement of the second boom 34. Since the third boom 56 is being moved upwardly, the second roller 71 mounted thereon also moves upwardly. Again since the cable 75 has a fixed length and the length of the portion thereof between the attachment 76 and the roller 71 increases, the cable as attached at 77 to the fourth boom 57 causes the fourth boom 57 to move upwardly in synchronization with the movement of the third boom 56. Thus, all of the booms 34, 56 and 57 are quickly moved upwardly to the maximum extension position illustrated in FIG. 2, which may be a height of 65 feet from the ground, or even more.

As seen in FIG. 2, when the boom assembly 20 is extended the first pivotal connection 27 thereof is located to the rear of the rear axle 13 of the van 11. The spacing 78 between the center line of the rear axle 13 and the centerline of the pivot point 27 (which is substantially in line with the center of the vertical extension of the boom assembly 20) is preferably provided about 12–20 inches (e.g. about 16 inches) to the rear of the center line of the axle 13; that is the distance 78 is preferably between about 12–20 inches. When so positioned substantially the full weight of the van 11 is provided to stabilize the boom 20, the boom 20 is positioned to allow substantially the full length of the van 11 to be used to mount the boom in the transport position (FIGS. 1 and 4), and this positioning substantially insures that the actual axle weights of both the front and rear axles 12, 13 are below the gross vehicle weight (GVW) ratings thereof.

If the cylinders 22, 67 are hydraulic, they are powered by a hydraulic system. Preferably the hydraulic system is electric over hydraulic, with the power being generated by batteries. The hydraulic system has two speeds allowing full speed operation when elevating and telescoping, and when moving the test equipment 59 downwardly so as to conduct tests at several elevations. A slower speed allows stowing of the boom assembly 20 for road travel (FIGS. 1 and 4 position), e.g. the boom slows down just before it goes on the roof 14—about a foot above—so that it does not impact the roof. The details of an exemplary hydraulic and system that can be utilized in the practice of the invention is schematically seen in FIGS. 12 and 13, with a control panel, and the operation thereof also being schematically illustrated in FIGS. 2 and 5.

Figure 12:
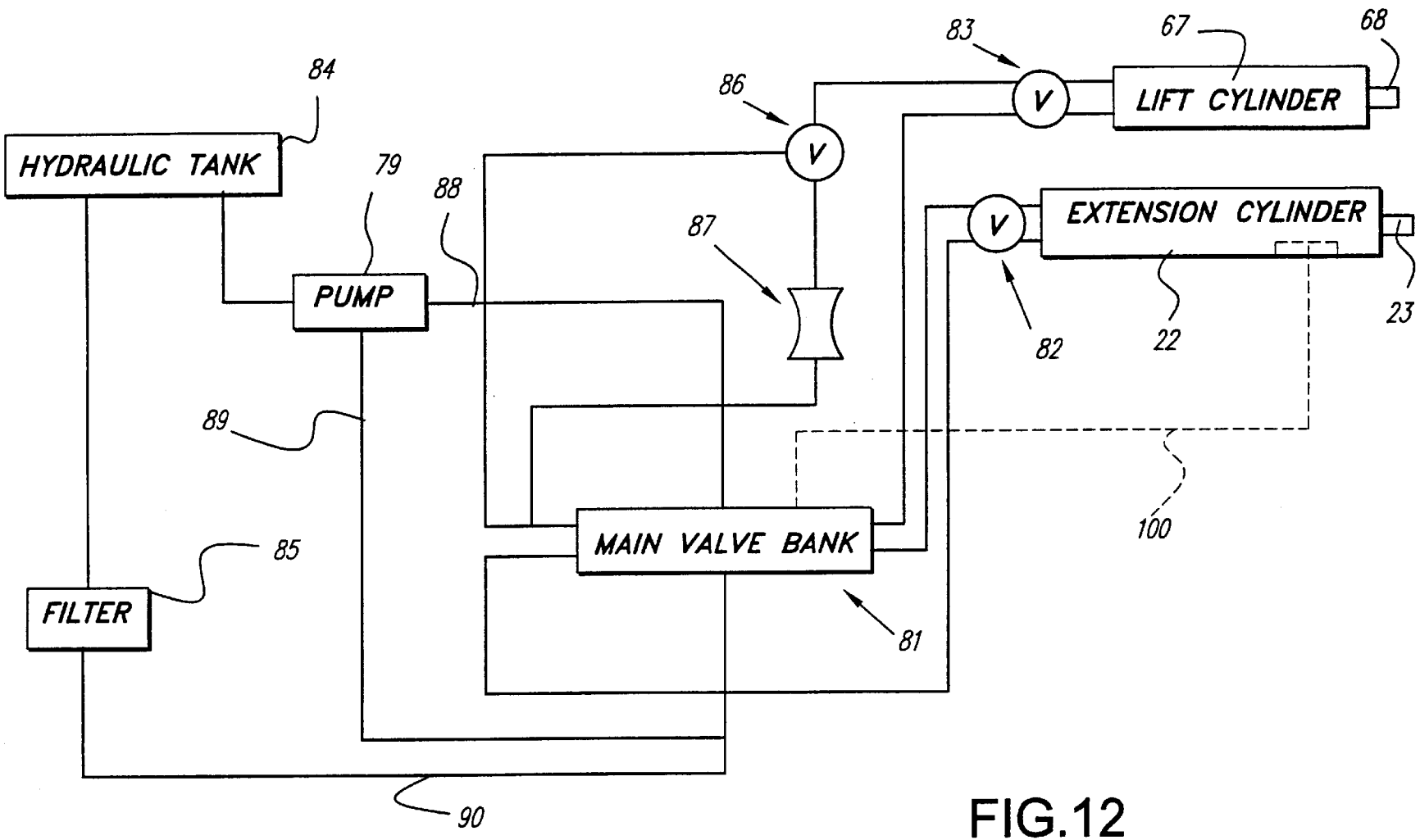
FIGS. 12 and 13 are hydraulic and electrical schematics, respectively, for one exemplary embodiment of the hydraulic and electrical components utilizable with the van and boom assembly of FIGS. 1 through 11.

A common, conventional, hydraulic pump 79 is provided for operating both the extension cylinder 22 and the lift cylinder 67, as seen in FIG. 12. The pump 79 is operated by a conventional electric pump motor 80 (FIG. 13). The pump 79 is connected through a main valve bank 81 to both the cylinders 22, 67, each of which has a conventional holding valve 82, 83, respectively, associated therewith. Hydraulic fluid is provided in an hydraulic tank 84 which has a conventional filter 85 associated therewith. Hydraulic fluid is passed through the main valve bank 81 before passing to the lift cylinder 67, and first passes through a conventional two-speed valve 86. Depending upon operator selection, the first speed allows maximum flow of hydraulic fluid under pressure to the lift cylinder 67, as when the boom assembly 20 is being extended (to the position illustrated in FIG. 2), whereas the second speed is a slow speed for stowing, etc. A conventional flow restricter 87 is preferably also connected to the two speed valve 86. The pressurized line from the pump 79 is the line 88 while the line 89 is a pressure relief line. The return line from the cylinders 67, 22, is the line 90.

Figure 13:
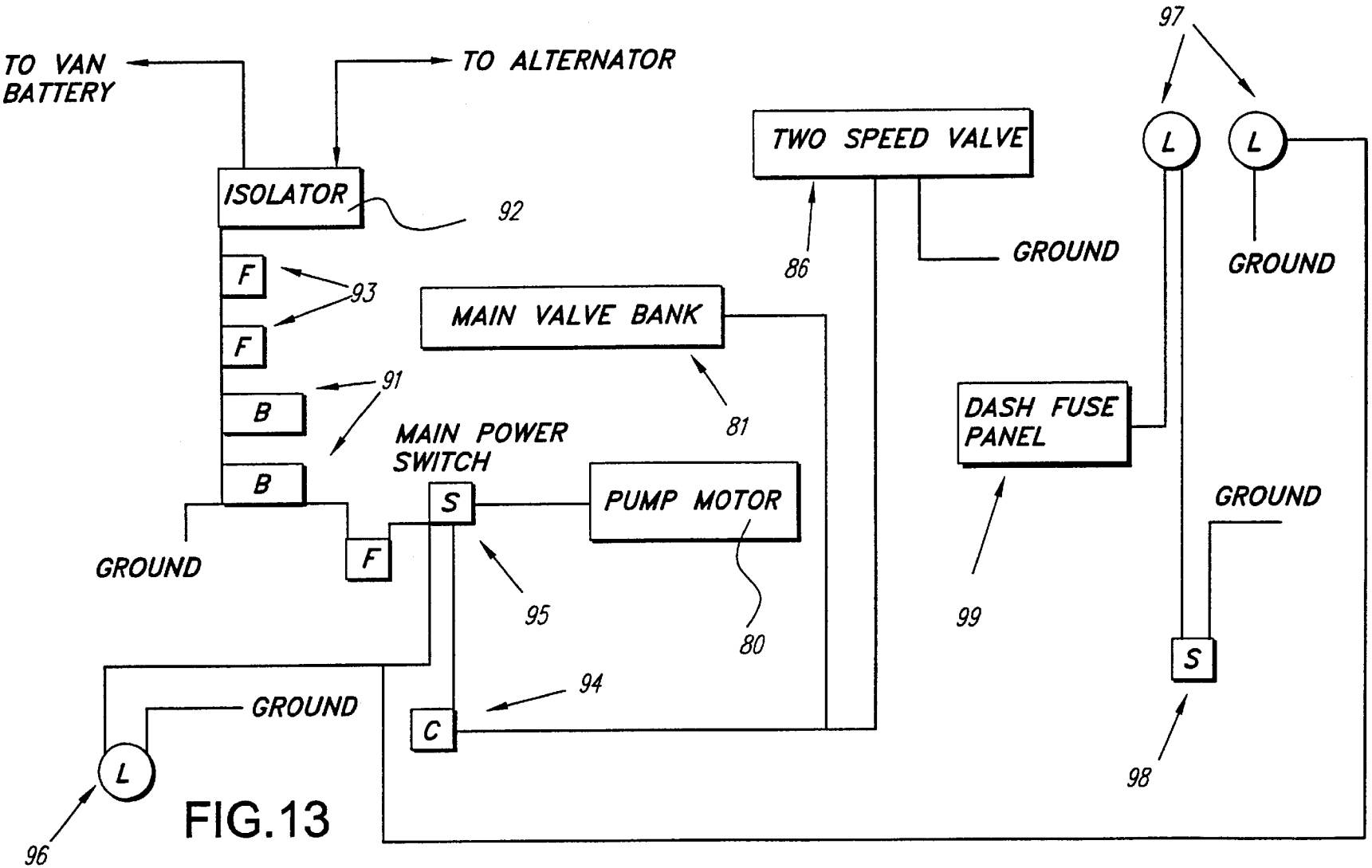

The power source for powering the pump motor 80 preferably comprises the battery or batteries illustrated schematically at 91 in FIG. 13. Preferably two deep cycle six volt batteries 91 are provided which are charged by the van's alternator, but are isolated from the van's battery by conventional isolator 92. Multiple fuses 93 are preferably provided (e.g. all electric circuits are double fused) in order to provide maximum protection.

The two speed valve 86 and the main valve bank 81 preferably include solenoid operated valves. Current to the valve solenoids is provided from the batteries 91 through a control box 94. A main power switch 95 also may be provided which can cut off power to both the pump motor 80 and the control box 94 when moved to the off position. The control box 94 as seen in FIGS. 2 and 5 is connected by a flexible elongated electric cable 95 (e.g. twelve or more feet long) so that the operator—as seen in FIG. 2—may stand entirely exteriorly of the van 11 to clearly see the boom 20 as it is moved to the second, vertical position by the extension cylinder 22, and as the boom 20 is elevated and retracted. The actual controls provided on the control box 94 may be of any conventional structure such as toggle switches, push buttons, momentary switches, etc. That is, by operating switches on the control box 94 the operator controls the valves in the main valve bank 81 and the two speed valve 86. The box 94 may be used to control other components too if desired. For example, the main power switch 95 could be placed on the control box 94 if desired.

Preferably indicator lights are also associated with various components. For example, an on-off indicator light 96 is provided which is operatively connected to the main power switch 95 and indicates whether the entire system is running or not. Dash indicator lights 97 indicate the position of the boom, whether or not the system is turned on, etc. A boom indicator light switch 98 is typically also provided, and the indicator lights 97 are preferably connected to the dash fuse panel 99 of the van 11.

A wide variety of other components may also be utilized if desired. For example, a conventional interlock—shown schematically at 100 in FIG. 12—may be provided between the extension cylinder 22 and the valve bank 81 to prevent operation of the lift cylinder 67 unless the extension cylinder 22 is in the fully extended position (of FIGS. 2 and 3).

The hydraulic lines leading from the hydraulic system of FIG. 12 to the cylinders 22, 67 typically pass through a sealed (water-tight) opening in the van roof 14, as illustrated schematically at 101 in FIG. 3. The pump 79, tank 84, batteries 91, pump motor 80, and primary valves 81, 86 are mounted in the van 11 in a readily accessible position, but one that does not interfere with ingress and egress to the van 11. The mounting area for all those components is illustrated schematically at 102 in FIG. 5.

Where power needs to be supplied from ground to the equipment 59, a coiled electrical cable 104 (see FIG. 1) may be used. The cable 104 is connected to any suitable power source on the ground (including possibly the batteries 91, or an AC plug in a building), and to the equipment 59 at the end of boom 57. Since the cable 104 is longer than the combined extended lengths of the booms 26, 34, 56 and 57, and since it is exterior of all of the boom telescopic action, the cable 104 effectively supplies power to the equipment 59 while not interfering with extension or retraction of the boom assembly 20.

Utilizing the hydraulic and electric system described with respect to FIGS. 12 and 13, and the boom assembly 20 such as described with respect to FIGS. 2, 4, and 11, it is possible to move the boom assembly 20 from the transport position of FIG. 1 to the fully extended position of FIG. 2 in less than five minutes, and in a safe and efficient manner. Yet the boom assembly 20 may be slowly lowered and held in any intermediate position between the fully extended position and the position in which the first boom 26 is vertical but the second through fourth booms 34, 56, 57 have not yet been extended. For many situations the optimum maximum extension of the boom assembly 20 (that is the height of the end cap 58 from the ground) is about 65 feet, but other constructions can be made in which there is a lesser maximum extension, or even a greater one. If more than five booms and an extension significantly greater than 65 feet (e.g. over 100 feet) are used, the assembly would then not be mounted on a van, but a truck.

It will thus be apparent that according to the present invention a highly advantageous boom assembly system is provided which is easily associated with a conventional van, yet which does not significantly interfere with egress or ingress from and to the van, and allows safe, quick, and efficient storage and activation of the boom assembly. While the invention has been herein shown and described in what is presently conceived to be the most practical and preferred embodiment thereof it will be apparently to those of ordinary skill in the art that many modifications may be made thereof within the scope of the invention, which scope is to be accorded the broadest interpretation of the appended claims so as to encompass all equivalent structures and systems.

What is claimed is:

1. A van with a boom assembly comprising:

a van including a front axle, a rear axle, a roof, a floor, an interior, and a main frame for mounting said front and rear axles;

a boom assembly positioned above said roof and comprising: a main pedestal; an extension linear actuator assembly having a rod with a free end, and an end of said actuator assembly opposite said rod free end; a first boom having first and second ends; a first pivotal connection for operatively pivotally mounting said first boom adjacent said first end to said main pedestal for pivotal movement about an axis substantially parallel to said rear axle; a second pivotal connection for operatively pivotally mounting said free end of said rod to one of said first boom and said main pedestal, and a third pivotal connection for operatively pivotally mounting said opposite end of said actuator assembly to the other of said main pedestal and said first boom;

a support frame which is disposed in said van interior and substantially supports said main pedestal on said main frame; and a second boom which telescopes with respect to said first boom;

said extension linear actuator assembly capable of moving said first boom from a first position substantially parallel to said van roof to a second position substantially perpendicular to, and extending upwardly from, said van roof.

2. A van with boom assembly as recited in claim 1 wherein said support frame comprises a plurality of substantially vertical support posts, each post being telescoping so as to allow ready movement into said van interior, and then to effectively support said main pedestal once fastened within said van interior; and a plurality of cross elements connecting said posts adjacent the tops thereof.

3. A van with boom assembly as recited in claim 2 further comprising a plurality of spacers disposed between said roof and main pedestal above said roof, and between said roof and cross elements within said van interior.

4. A van with boom assembly as recited in claim 3 further comprising a plurality of spacers disposed between said support frame and said floor in said van interior, and a plurality of spacers operatively disposed between said floor and said main frame below said floor; and wherein said van comprises a fourteen–twenty-four foot van.

5. A van with boom assembly as recited in claim 1 wherein said extension linear actuator assembly comprises an hydraulic extension cylinder, and said rod comprises a piston rod; and further comprising a hydraulic lift cylinder connected between said first and second booms for linearly moving said second boom with respect to said first boom in telescoping relationship; and a common electrically powered hydraulic fluid pump for supplying hydraulic fluid under pressure to said extension and lift cylinders.

6. A van with boom assembly as recited in claim 5 further comprising a third boom telescoping within said second boom, and movable substantially vertically upwardly with respect to said second boom by a cable and roller connection between said first and third booms.

7. A van with boom assembly as recited in claim 6 further comprising a fourth boom telescoping within said third boom, and movable substantially vertically upwardly with respect to said third boom by a cable and roller connection between said second and fourth booms; and further comprising a removable equipment-mounting end cap for said fourth boom.

8. A van with boom assembly as recited in claim 5 wherein electric power for powering said pump, and solenoid operated valves associated therewith, comprises one or more batteries mounted in said van.

9. A van with boom assembly as recited in claim 8 wherein the supply of electric current to said pump and valves is controlled through a control box mounted on an elongated electric cable allowing an operator to stand at a position remote from said van to observe movement of said booms while operating said control box.

10. A van with boom assembly as recited in claim 1 wherein said van has rear and side doors, and wherein said support frame is disposed in said van interior in a manner which does not interfere with ingress or egress through said doors, and leaves the center of said van interior substantially unobstructed.

11. A van with boom assembly as recited in claim 5 further comprising solenoid operated valves associated with said common pump, one of said valves comprising a two speed valve operatively connected between said common pump and said cylinder lift.

12. A van with boom assembly as recited in claim 1 wherein said pivotal connection for said first boom when in said second position is located on the opposite side of said rear axle from said front axle so as to allow substantially the full weight of said van to stabilize said booms, and to substantially insure that the actual axle weights of both axles are below the GVW ratings thereof.

13. A van with boom assembly as recited in claim 12 wherein the centerline of said first pivotal connection when said first boom is in said second position is approximately 12–20 inches to the rear of the centerline of said rear axle.

* * * * *